US007621095B2

(12) United States Patent
Dean, Jr.

(10) Patent No.: US 7,621,095 B2
(45) Date of Patent: Nov. 24, 2009

(54) BLOCK-TYPE RETAINING WALL WITH PLANTER FEATURE

(75) Inventor: Robert W. Dean, Jr., Shorewood, WI (US)

(73) Assignee: Dean Holding Corporation, Lake Elmo, MN (US)

( * ) Notice: Subject to any disclaimer, the term of this patent is extended or adjusted under 35 U.S.C. 154(b) by 798 days.

(21) Appl. No.: 11/037,557

(22) Filed: Jan. 18, 2005

(65) Prior Publication Data

US 2006/0156674 A1 Jul. 20, 2006

(51) Int. Cl.

| | |
|---|---|
| ***E04B 5/04*** | (2006.01) |
| ***E04C 2/04*** | (2006.01) |
| ***E04B 1/38*** | (2006.01) |
| ***E04B 1/02*** | (2006.01) |

(52) U.S. Cl. ..... 52/603; 52/285.3; 52/562; 52/597; 52/606; 52/379

(58) Field of Classification Search ..... 52/606, 52/608, 609, 284, 379, 169.4, 597, 603, 285.3, 52/562; 405/262, 284

See application file for complete search history.

(56) References Cited

U.S. PATENT DOCUMENTS

| | | | | | |
|---|---|---|---|---|---|
| 3,295,287 | A | * | 1/1967 | Pasquale | 52/714 |
| 3,995,434 | A | * | 12/1976 | Kato et al. | 405/33 |
| 4,920,712 | A | * | 5/1990 | Dean, Jr. | 405/286 |
| 4,998,397 | A | * | 3/1991 | Orton | 52/715 |
| 5,044,834 | A | * | 9/1991 | Janopaul, Jr. | 405/284 |
| 5,252,017 | A | * | 10/1993 | Hodel | 411/446 |
| 5,474,405 | A | * | 12/1995 | Anderson et al. | 405/286 |
| 5,481,812 | A | * | 1/1996 | Pedano | 33/613 |
| 5,620,283 | A | * | 4/1997 | Walter | 405/286 |
| 5,707,184 | A | * | 1/1998 | Anderson et al. | 405/286 |
| 5,711,130 | A | * | 1/1998 | Shatley | 52/604 |
| 5,735,643 | A | * | 4/1998 | Castonguay et al. | 405/286 |
| 6,622,445 | B1 | * | 9/2003 | Shillingburg et al. | 52/606 |

(Continued)

OTHER PUBLICATIONS

Rock Retaining Wallls . . . Brochure, Redi-Rock, International, www.redi-rock.com, undated.

(Continued)

*Primary Examiner*—Richard E Chilcot, Jr.
*Assistant Examiner*—Andrew J Triggs
(74) *Attorney, Agent, or Firm*—Boyle Fredrickson, S.C.

(57) ABSTRACT

A retaining wall is formed of a series of courses of blocks, each of which includes a core. Engagement members are interposed between the blocks in adjacent courses for preventing relative forward movement between the blocks in adjacent courses. Each engagement member is mountable to the rear web of a lower block, and includes an upstanding projecting portion that engages the rear web of an upper block for preventing forward movement of the upper blocks relative to the lower blocks. The upstanding projecting portion engages the rear web of the upper block so that the front face of the upper block is located rearwardly of the front web of the lower block, to expose an upwardly open forward portion of the core of the lower block. The exposed portion of the lower block core may receive planting media, to enable plants to be planted in the exposed core of the lower block.

12 Claims, 8 Drawing Sheets

U.S. PATENT DOCUMENTS

| | | | | |
|---|---|---|---|---|
| 6,701,687 | B1 * | 3/2004 | Shillingburg | 52/606 |
| 6,821,058 | B1 * | 11/2004 | Dawson | 405/284 |
| 6,827,527 | B2 * | 12/2004 | Conkel et al. | 405/284 |
| 6,857,240 | B1 * | 2/2005 | MacAlister | 52/564 |
| 6,912,819 | B2 * | 7/2005 | Price et al. | 52/285.3 |
| 2003/0009970 | A1 * | 1/2003 | MacDonald et al. | 52/562 |
| 2003/0221386 | A1 * | 12/2003 | McDonald | 52/568 |
| 2006/0110222 | A1 * | 5/2006 | Price | 405/286 |

OTHER PUBLICATIONS

GreenWall By Paverlock, Paverlock, 4600 Devitt Drive, Cincinnati, Ohio 45246, undated.

Soil Retention Products, Vendura, 2501 State Street, Carlsbad, CA 92008, undated.

Planter Wall by Keystone Retaining Wall Systems, undated.

* cited by examiner

BLOCK-TYPE RETAINING WALL WITH PLANTER FEATURE

BACKGROUND AND SUMMARY OF THE INVENTION

This invention relates to a retaining wall formed of a stacked courses of blocks, and more particularly to such a retaining wall having a planting feature that enables plants to be planted in the wall to enhance the appearance of the wall.

Retaining walls formed of stacked courses of blocks are well known. One example of such a retaining wall is illustrated in Dean, Jr. U.S. Pat. No. 4,920,712 issued May 1, 1990, the disclosure of which is hereby incorporated by reference. The '712 patent discloses a retaining wall construction which utilizes clips that are mounted between blocks in adjacent courses for positioning the upper course blocks relative to the lower course blocks. Each clip is mounted to the upper area of the rear web of a lower block, and includes an upwardly projecting portion that extends above the upper surface of the lower block. The rear webs of the blocks are formed so that the inner surface of the rear web at the lower surface of the block is located forwardly of the inner surface of the rear web at the upper surface of the block. The upwardly projecting portion of the clip is received within the core of the upper block, and the upper block is positioned so that the inner surface of the rear web engages the upwardly extending portion of the clip. The configuration of the rear web provides a rearward offset of the upper block relative to the lower block. A retaining wall constructed utilizing the blocks as described in the '712 patent provides relatively quick and easy installation, and the clip arrangement provides consistent positioning of the blocks as the courses of the wall are constructed.

It is an object of the present invention to provide a block-type retaining wall that incorporates a feature for setting back blocks in an upper course relative to blocks in a lower course, for enabling plants, foliage or other greenery to be planted in the wall and to enhance the overall appearance of the wall. Another object of the invention is to provide a block-type retaining wall which utilizes the setback between block courses to provide a seating feature. Another object of the invention is to provide such a retaining wall that is constructed in a manner similar to prior art retaining walls, while incorporating a setback feature to provide. A further object of the invention is to provide such a retaining wall in which a plantar feature can be incorporated in various locations and configurations in the wall. A still further object of the invention is to provide such a retaining wall which is capable of incorporating a drip-type irrigation feature.

In accordance with the present invention, a retaining wall is formed of a series of courses of stacked blocks, each of which includes a front face; a rear wall spaced from the front face; an upper block surface; a lower block surface; and a core extending through the block between the upper block surface and the lower block surface. The area of the block between the core and the rear wall of the block defines a rear web and the area between the core and the front face defines a front web. Each of the courses is formed of a series of the blocks placed in a side-by-side relationship, and a joint is formed between the blocks in adjacent upper and lower courses by the lower and upper block surfaces, respectively, of the blocks forming the upper and lower courses. A series of engagement members are interposed between the blocks in adjacent courses for preventing relative forward movement between the blocks in adjacent courses. Each engagement member is mountable to the rear web of a lower block in a lower course, and includes an upstanding projecting portion configured to engage the rear web of an upper block placed in an adjacent upper course for preventing forward movement of blocks in the upper course relative to blocks in the lower course. The upstanding projecting portion of the clip member is configured to engage the rear web of the upper block so that the front face of the upper block is located rearwardly of the front web of the lower block, to expose an upwardly open forward portion of the core of the lower block. The exposed portion of the core of the lower block is adapted to receive planting media, to enable plants to be planted in the exposed core of the lower block. Alternatively, the exposed upper surfaces of the lower blocks may be used to mount a cap-type block to provide a seating or other support surface in the wall.

The engagement member is preferably in the form of a clip member configured for engagement with the rear web of the lower block. In one form, the clip member includes a substantially horizontal portion for placement adjacent the upper surface of the lower block, and the upstanding projecting portion extends upwardly from the horizontal portion. The substantially horizontal portion of the clip member is defined by an inverted U-shaped mounting portion configured to engage the rear web of the lower block, and the mounting portion includes a pair of legs that extend downwardly from the substantially horizontal portion of the clip member. A recess may be formed in the upper surface of the lower block, for receiving the substantially horizontal portion of the clip member to prevent interference with the joint. The rear web of the upper block includes an inner surface forming the core, and the upwardly projecting portion of the clip member engages the inner surface of the rear web of the upper block to position the upper block relative to the lower block.

The clip member is configured to be engaged with the rear web of the lower block in either a first orientation in which the upstanding projecting portion is located rearwardly of the rear wall of the lower block, or in a second orientation in which the upstanding projecting portion is located forwardly of the rear wall of the lower block within the core. The upstanding projecting portion engages the rear web of the upper block when the clip member is in the first orientation. The clip member also may include a second upwardly projecting portion that is configured to engage the rear web of the upper block when the clip member is in the second orientation. The second upwardly projecting portion is configured to position the upper block forwardly so that the core of the lower block is not exposed when the upper block is placed on the lower block.

The invention also contemplates a method of forming a block-type retaining wall, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
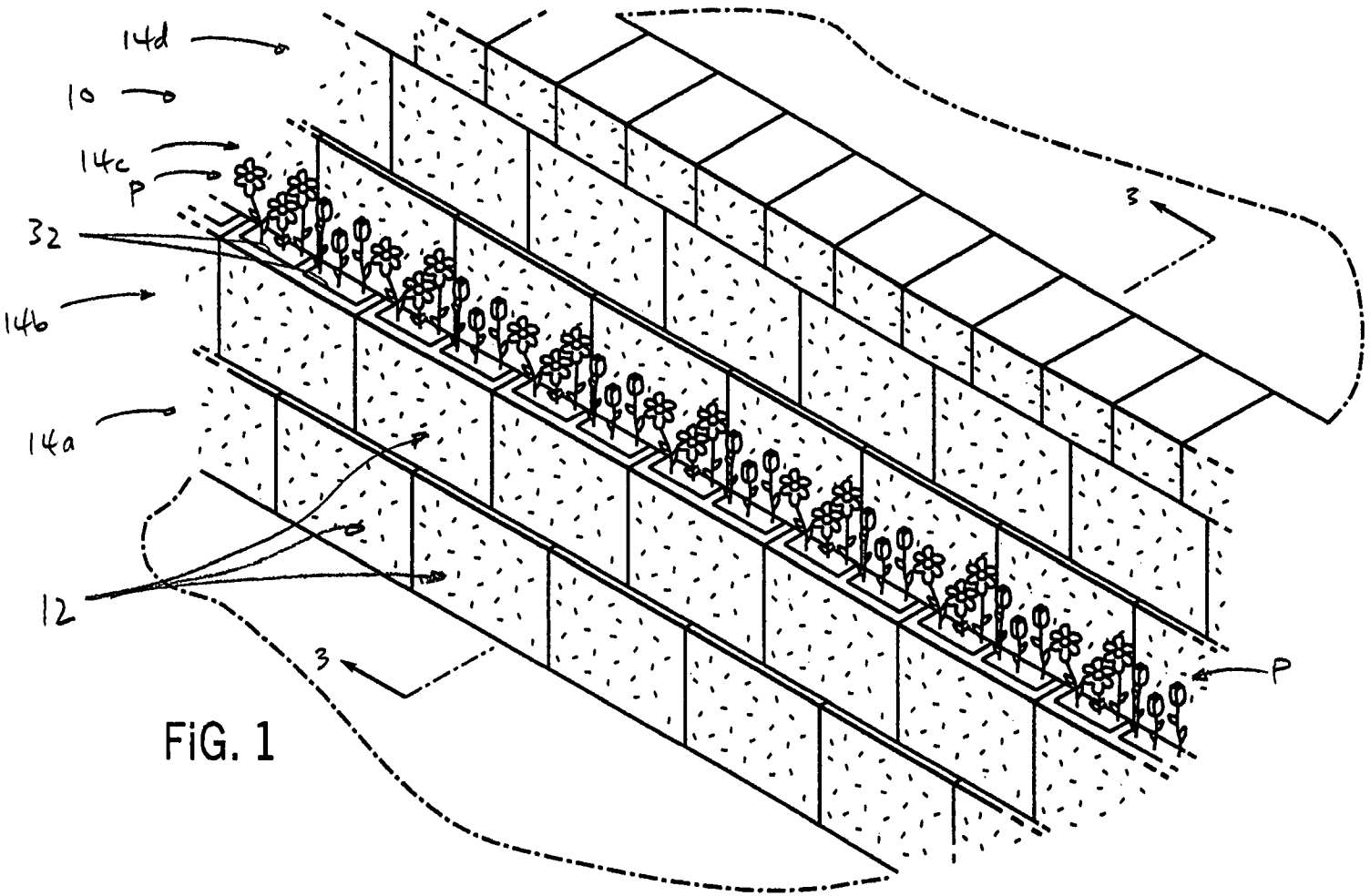
FIG. 1 is an isometric view of a portion of a retaining wall incorporating a setback feature, in accordance with the present invention, for providing a planting or seating feature in the wall.
Figure 2:
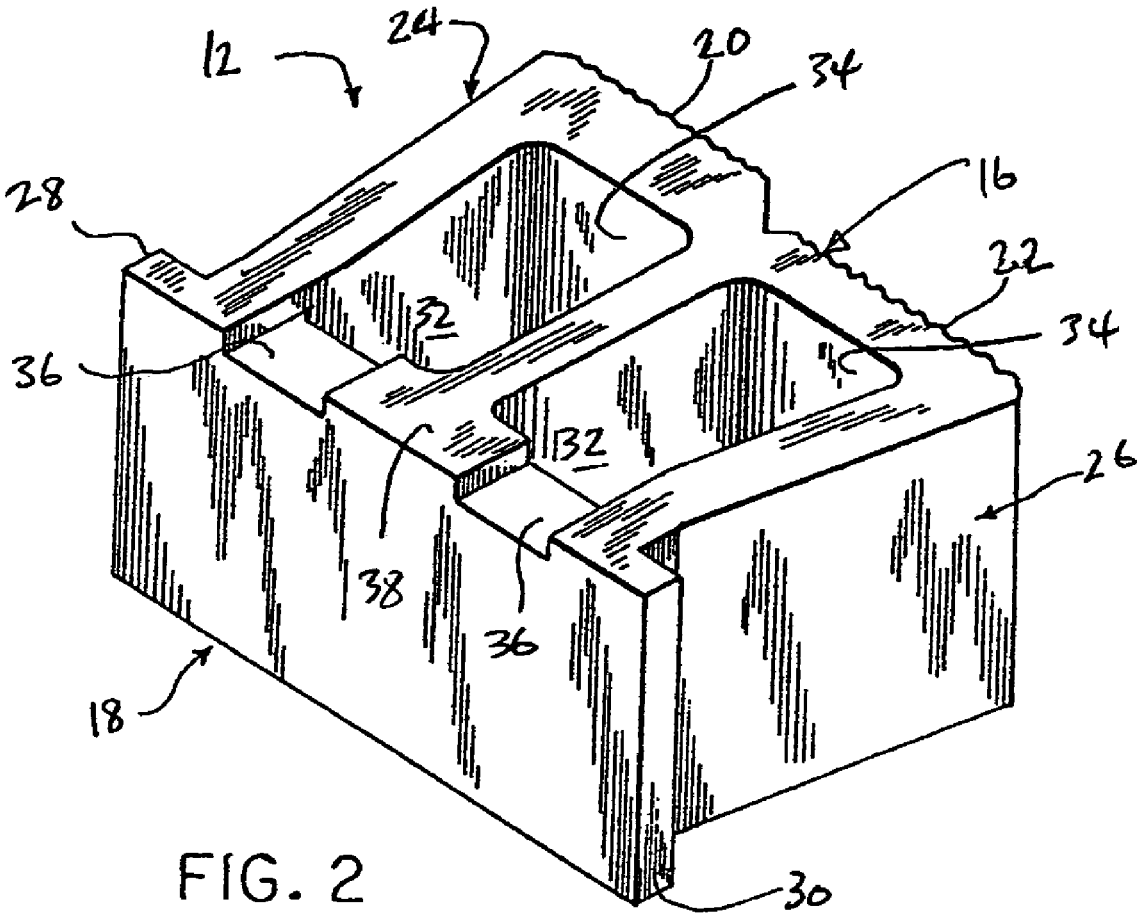
FIG. 2 is an isometric view of a representative embodiment of a block used to construct the retaining wall of FIG. 1.

Referring to FIGS. 1 and 2, a retaining wall 10 is constructed of a series of courses of concrete blocks 12. In a manner as is known, blocks 12 are constructed in courses such as 14*a*, 14*b*, 14*c* and 14*d*, with each course being constructed of a series of blocks 12 placed in a side-by-side relationship. The blocks 12 in adjacent courses are staggered so that the joints between the blocks in adjacent courses are not in vertical alignment, to increase the overall strength and rigidity of retaining wall 10. Blocks 12 may have a construction as shown and described in Dean, Jr. U.S. Pat. No. 4,920,712, incorporated above by reference. Generally, each block 12 includes a front web 16 and a rear web 18. The outwardly facing surface of front web 16 defines a block face, which may be split along separate splitting planes to form separate block face sections 20, 22. It is understood, however, that the face of block 12 may have any other configuration than the specific configuration as shown. In addition, block 12 includes a pair of sidewalls 24, 26, which extend between front web 16 and rear web 18. Sidewalls 24, 26 are tapered in a front-to-rear direction, to provide a maximum block width at the front face of block 12 and a minimum block width adjacent rear web 18. A pair of ears 28, 30 project outwardly from rear web 18, rearwardly of the area of minimum block width as defined by sidewalls 24, 26. A pair of block cores 32 are formed in block 12, and extend between the upper block surface and the lower block surface in a manner as is known. Cores 32 form inner surfaces of front web 16, shown at 34.

A pair of recesses 36 are formed in the upper surface of rear web 18, shown at 38.

The above construction of block 12 is generally known, and is available under the designation STONEWALL SELECT™ from Innovative Concrete Design Corporation of Milwaukee, Wis. It should be understood, however, that the illustrated construction of blocks 12 is exemplary of any number of different block configurations that may be utilized to form retaining wall 10 having a planter feature as will be described.

Figure 6:
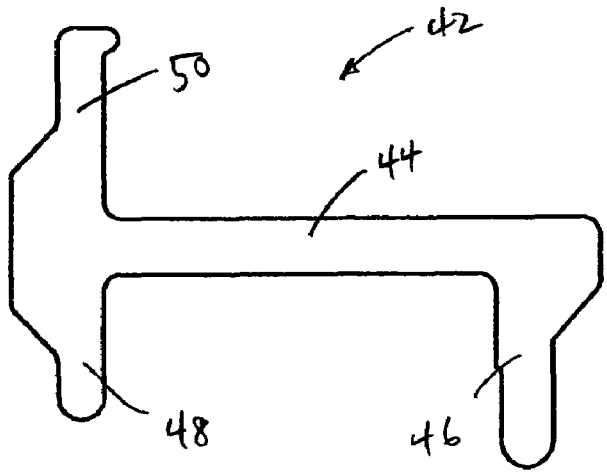
FIG. 6 is an elevation view of a prior art clip-type engagement member for placement between blocks in adjacent courses that provides a conventional setback between courses.

In order to provide engagement between conventionally constructed block courses, such as between courses 14*a* and 14*b* or courses 14*c* and 14*d*, a series of engagement members such as clips 42 (FIGS. 3, 6) are mounted to the lower course blocks 12 and engaged with the upper course blocks 12. Each clip 42 is adapted for mounting to the rear web 18 of a lower course block 12 at one of the recesses 36. Clip 42 includes an upper transverse member 44 from which a pair of legs 46, 48 depend. An upwardly projecting portion 50 is aligned with depending leg 48 and projects above upper transverse member 44.

Figure 3:
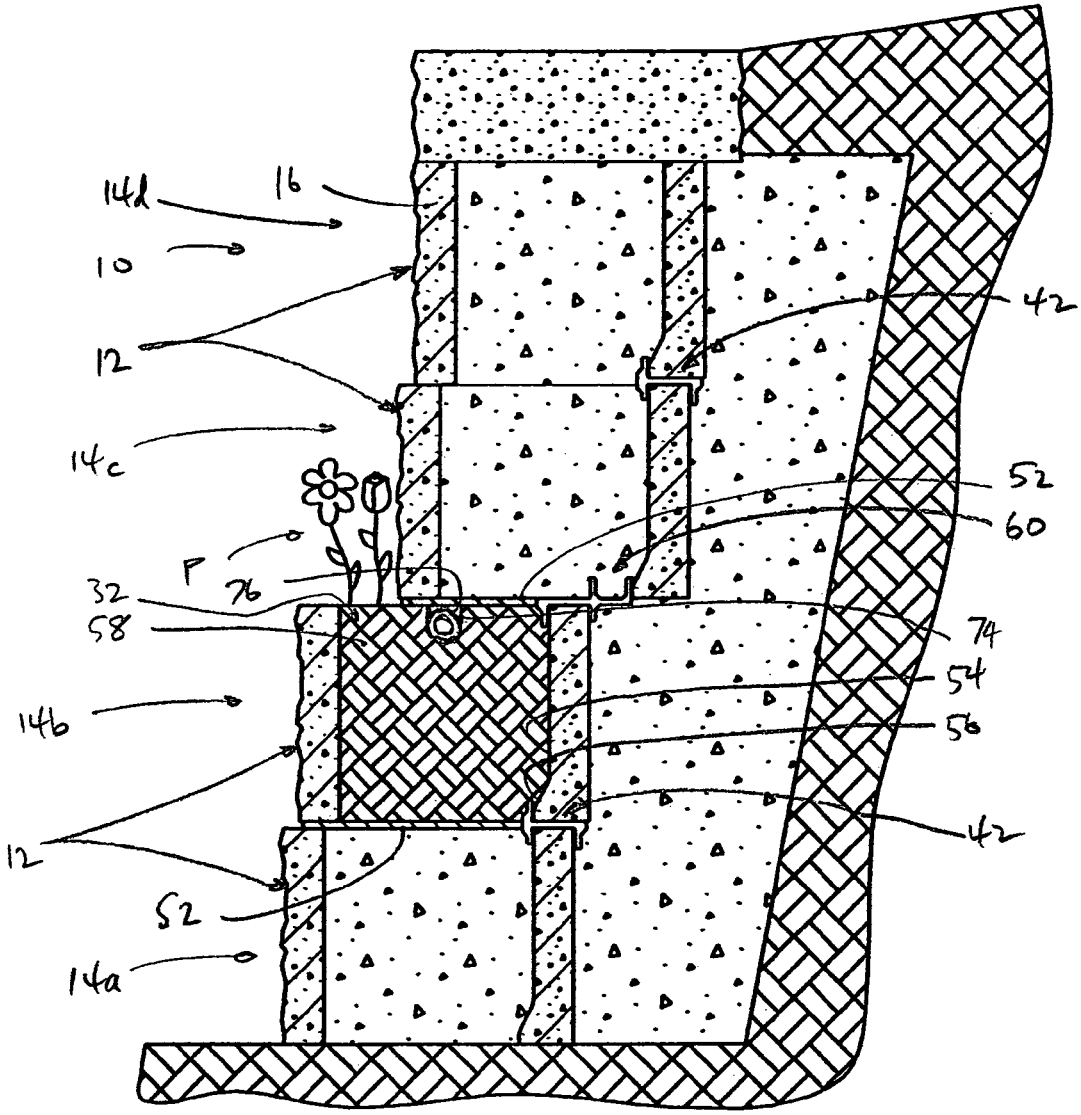
FIG. 3 is a partial section view taken along line 3-3 of FIG. 1.

As shown in FIG. 3, a lower course such as 14*a* is formed from a series of blocks 12 placed side-by-side so that the ends of the front web 16 of each block 12 are placed closely adjacent the end of the front web 16 of a neighboring block 12 in course 14*a*. Similarly, ears 28, 30 at the rear of each block 12 are placed so that their ends are closely adjacent the respective ears of neighboring blocks 12. After construction of lower course 14*a*, the block cores 32 are filled with a backfill material, as are the cavities between the sidewalls 24, 26 of the adjacent blocks, to reinforce the strength of the block course 12.

A clip 42 is engaged within each recess 36 formed in the upper surface 38 of rear web 18 of each block 12 in lower course 14*a*. Each clip 42 is oriented within its respective recess such that its depending leg 46 is adjacent to and engages the rear surface of rear web 18, and its depending leg 48 is adjacent to and engages the inner surface 34 of front web 20. The upper transverse member 44 of each clip 42 is positioned within a recess 36, so that the upper transverse member 44 does not extend above the upper block surface 38. When clip 42 is positioned in this manner, upwardly projecting portion 50 is oriented so that its rearwardly facing surface is substantially in line with the inner surface of rear web 18 adjacent the recess 36 within which clip 42 is mounted.

Course 14*b* is constructed by placing a series of blocks 12 in a side-by-side manner, as above, on top of the blocks 12 forming course 14*a*. Before course 14*b* is constructed, a length of filter fabric 52 is placed on top of certain of the blocks 12 in course 14*a*. The blocks 12 forming course 14*b* are placed in a staggered relationship relative to the blocks 12 forming course 14*a*, so that the blocks 12 in course 14*b* overlap the joint between the blocks 12 in course 14*a*.

The blocks 12 in course 14*b* are placed on the blocks 12 in course 14*a* such that the upwardly projecting portion 50 of each clip 42 extends into one of the cores 32 of each block 12 in course 14*b*. The blocks 12 in course 14*b* are then moved forwardly so that the rearward surface of upstanding portion 50 of each clip 42 engages the inner surface of rear web 18 of the blocks 12 in course 14*b*. In this manner, forward movement of the blocks 12 in course 14*b* relative to the blocks 12 in course 14*a* is prevented.

Each of the block cores 32 is formed so as to define the inner surface of rear web 18 in a manner that provides a greater thickness to rear web 18 adjacent the lower block surface than adjacent the upper block surface. That is, the inner surface of rear web 18 includes a substantially vertical upper portion 54 and a lower, inwardly tapered portion 56. With this construction of each block 12, an automatic offset of blocks 12 in an upper course, such as 14*b*, is provided relative to the blocks 12 in a lower course, such as 14*a*, when the wall 10 is constructed as described above. When a block 12 in an upper course is positioned on a block 12 in a lower course such that the upwardly projecting portion 50 of clip 42 projects into the core 32 of the upper block 12, and the upper block 12 is moved forwardly until engagement with the rearward surface of upwardly projecting portion 50 of clip 42, the increased thickness of the rear web 18 of the upper block 12 at its lower surface will provide the noted rearward offset or setback of the upper block 12. The rearward offset of the blocks 12 functions to provide an increase in the strength and stability of retaining wall 10.

Upper transverse member 44 of clip 42 is located within one of recesses 36, which has a depth sufficient to prevent any portion of upper transverse member 44 from projecting above upper surface 38. In this manner, the lower surface of an upper block 12 can be placed directly onto the upper surface of a lower block 12.

In one embodiment of the present invention, the blocks 12 in course 14*b* are destined to become "planter blocks" in that a forward portion of at least some of the cores 32 of blocks 12 in course 14*b* are exposed. Accordingly, blocks 12 in course 14*b* are backfilled with planting media 58, which may be topsoil, potting soil or any other media that facilitates plant growth. Filter fabric 52 functions to separate the planting media 58 from the backfill material placed in the cores of blocks 12 in lower course 14*a*, to maintain segregation of such materials.

Figure 4:
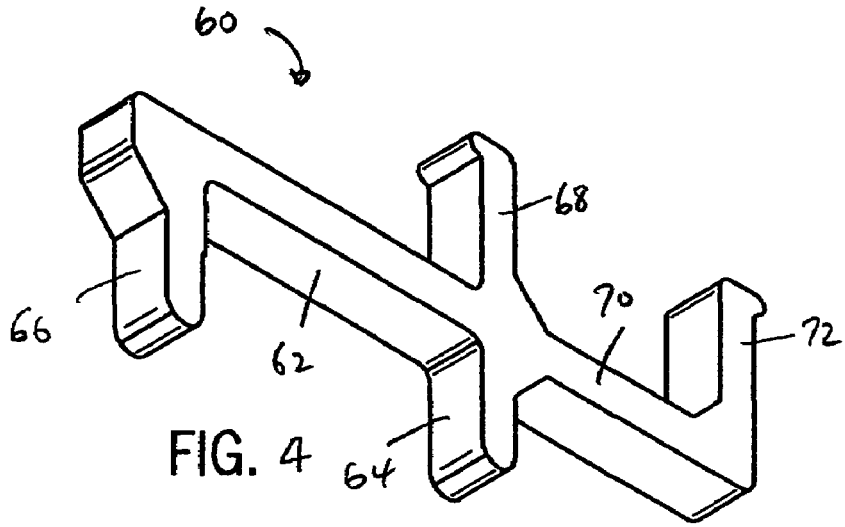
FIG. 4 is an isometric view of an engagement member in the form of a clip, which is incorporated in the retaining wall of FIGS. 1 and 3 and is configured to provide the setback between adjacent courses for providing the planter feature.
Figure 5:
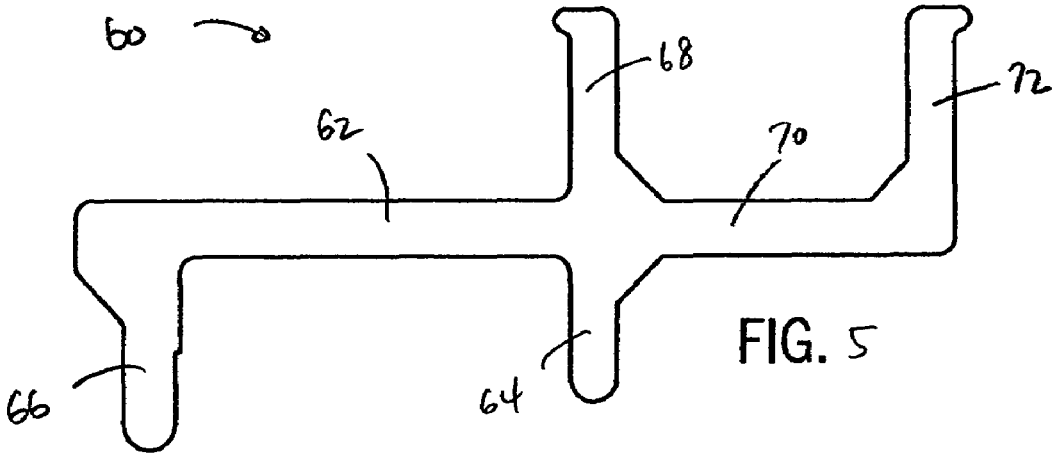
FIG. 5 is an elevation view of the engagement member of FIG. 4.

Referring to FIGS. 3-5, extended clips 60 are engaged with the rear web 18 of blocks 12 in course 14*b*, to provide a desired position of blocks 12 in course 14*c* in order to expose the forward portions of cores 32 in blocks 12 of course 14*b*. Each extended clip 60 includes an inverted U-shaped mounting portion, in a manner similar to that of clip 42. The inverted U-shaped mounting portion is defined by an upper transverse member 62 in combination with a pair of depending legs 64, 66. Extended clip 60 also includes an inner upwardly projecting portion 68 that extends vertically upwardly in alignment with leg 64, and a transverse extension 70 that extends from leg 64 and inner upwardly projecting portion 68. An outer upwardly projecting portion 72 extends upwardly from the outer end of transverse extension 70. Outer upwardly projecting portion 72 has a configuration similar to that of inner upwardly projecting portion 68, although upwardly projecting portions 68, 72 have a mirror image construction. It should also be noted that the configuration of extended clip 60, with the exception of transverse extension 70 and outer upwardly projecting portion 72, is essentially identical to that of clip 42.

In order to position blocks 12 of course 14*c* such that the forward portions of cores 32 of blocks 12 in course 14*b* are exposed, extended clips 60 are mounted to rear webs 18 of blocks 12 in course 14*b*, in a manner similar to that in which clips 42 are mounted to rear webs 18 of blocks 12 in course 14*a*. Extended clips 60 are engaged with rear webs 18 such that transverse extension 70 extends rearwardly of the rear web 18. That is, upper transverse member 62 is again received in the block recess 36, and leg 66 is placed against the inner surface of rear web 18 and leg 64 is placed against the outer surface of rear web 18.

Course 14*c* of retaining wall 10 is then constructed on top of course 14*b*, again by placing blocks 12 in course 14*c* in a side-by-side manner on top of blocks 12 in course 14*b*. Again, the blocks in course 14*c* overlap the joints between the blocks in course 14*b*, to strengthen the construction of retaining wall 10.

The blocks 12 in course 14*c* are placed on the blocks 12 in course 14*b* such that the outer upwardly projecting portion 72 of each extended clip 60 is located within one of the cores 32 of the blocks 12 forming course 14*c*. The blocks 12 in course 14*c* are then moved forwardly so that the rearward surface of outer upwardly projection portion 72 of each extended clip 60 engages the inner surface of rear web 18 of the blocks 12 in the upper course 14*c*. In this manner, forward movement of the blocks 12 in upper course 14*c* relative to the blocks 12 in lower course 14*b* is prevented. The configuration of extended clip 60 functions to position the face of the block 12 in upper course 14*c* rearwardly of the inner surfaces 34 defined by the front webs 16 of the blocks 12 in lower course 14*b*. The degree of exposure of the block cores 32 of blocks 12 in course 14*b* is determined by the rearward offset provided by extended clips 60, which may be any satisfactory dimension as desired, e.g. three to four inches, although it is understood that any other suitable rearward offset may be attained in this manner.

If desired, a layer of filter fabric 52 may also be placed between the blocks 12 in courses 14*b* and 14*c*, to maintain segregation between the backfill material placed into the blocks 12 of course 14*c* from the planting media 58 placed into the cores 32 of blocks 12 in course 14*b*.

The blocks 12 utilized to construct course 14*b* may be provided with a trough 74 for receiving a drip irrigation tube 76. In a manner as is known, drip irrigation tube 76 is closed at one end and has a fitting at the opposite end, to enable a conventional hose to be hooked to drip irrigation tube 76 so as to impart moisture to planting media 58.

With this construction, the exposed portion of cores 32 of blocks 12 in course 14*b* is used to plant foliage such as plants P. This ability to plant plants P in retaining wall 10 functions to increase the aesthetic appearance of retaining wall 10, by breaking up the concrete surface defined by the faces of blocks 12.

Additional courses, such as 14*d*, are then constructed so as to complete retaining wall 10. It can be appreciated, however, that the planter feature provided by the exposed cores 32 of blocks 12 can be placed in any location on the wall 10, and that numerous planter features may be provided in various locations, as desired. The specific configuration of wall 10 as shown and described is one of a virtually unlimited number of planter wall configurations that can be provided utilizing the construction of the present invention.

If desired, extended clip 60 may also be used in a manner similar to clip 42, to provide a conventional setback between adjacent block courses. To accomplish this, the orientation of extended clip 60 is reversed so that transverse extension 70 and outer upwardly projecting portion 72 extend forwardly into the core 32 of the upper block 12. In this orientation, the inner upwardly projecting portion 68 of extended clip 60 functions in the same manner as upwardly projecting portion 50 of clip 42, to position the blocks 12 in an upper course relative to the blocks 12 in a lower course.

Figure 7:
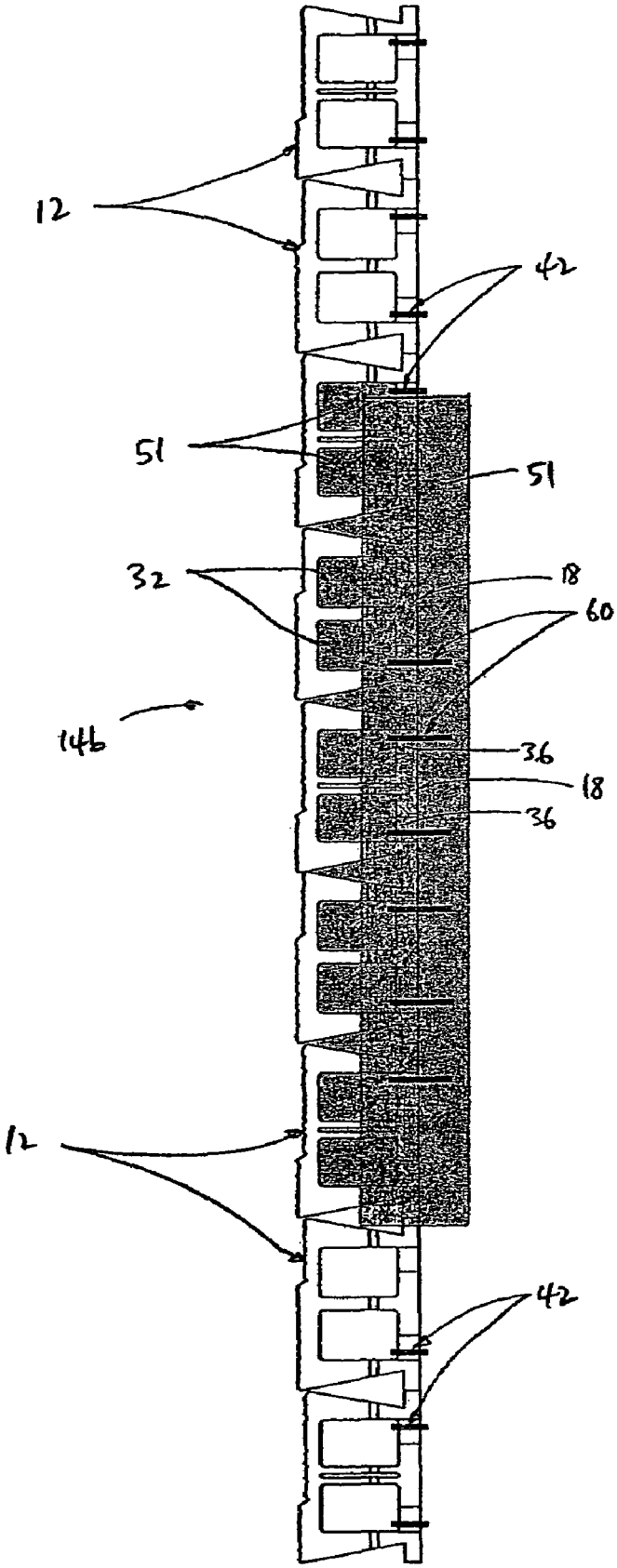
FIG. 7 is a plan view of a portion of a retaining wall such as FIG. 1, showing blocks in a lower course of the wall, wherein certain of the block cores are destined to be exposed upon construction of the wall.
Figure 8:
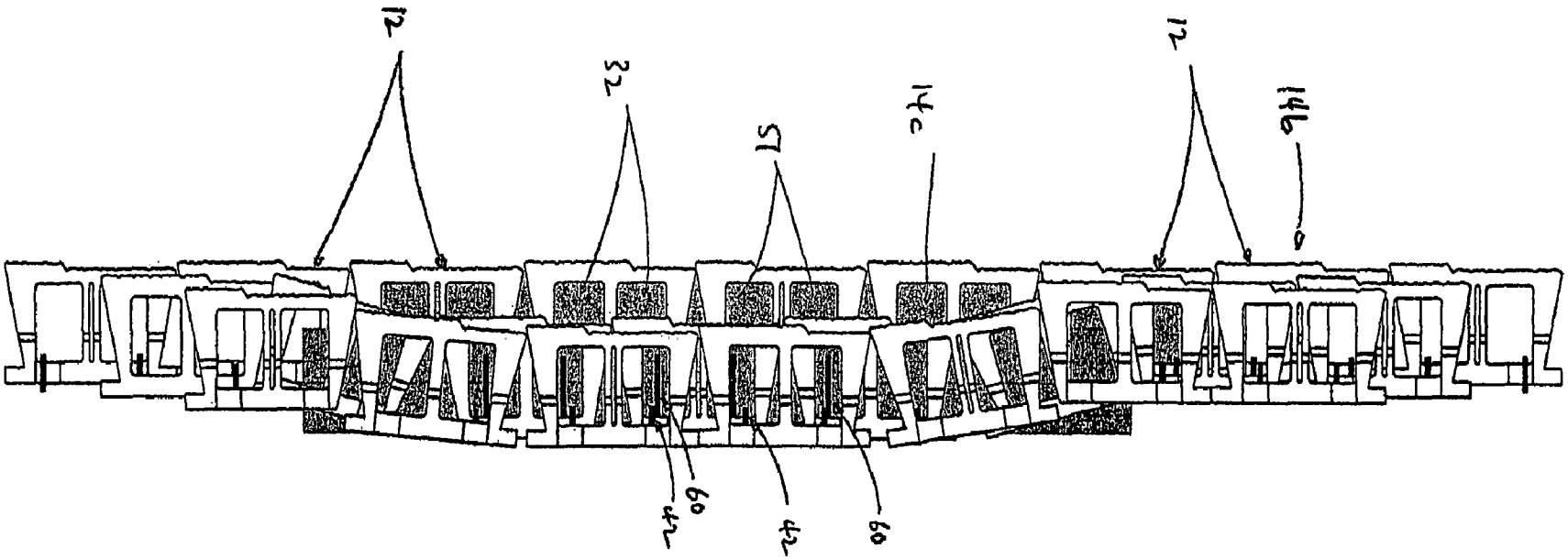
FIG. 8 is a view similar to FIG. 7, showing upper courses of blocks placed on the lower course, for exposing the cores of the lower course blocks to provide the planter feature in accordance with the present invention.
Figure 9:
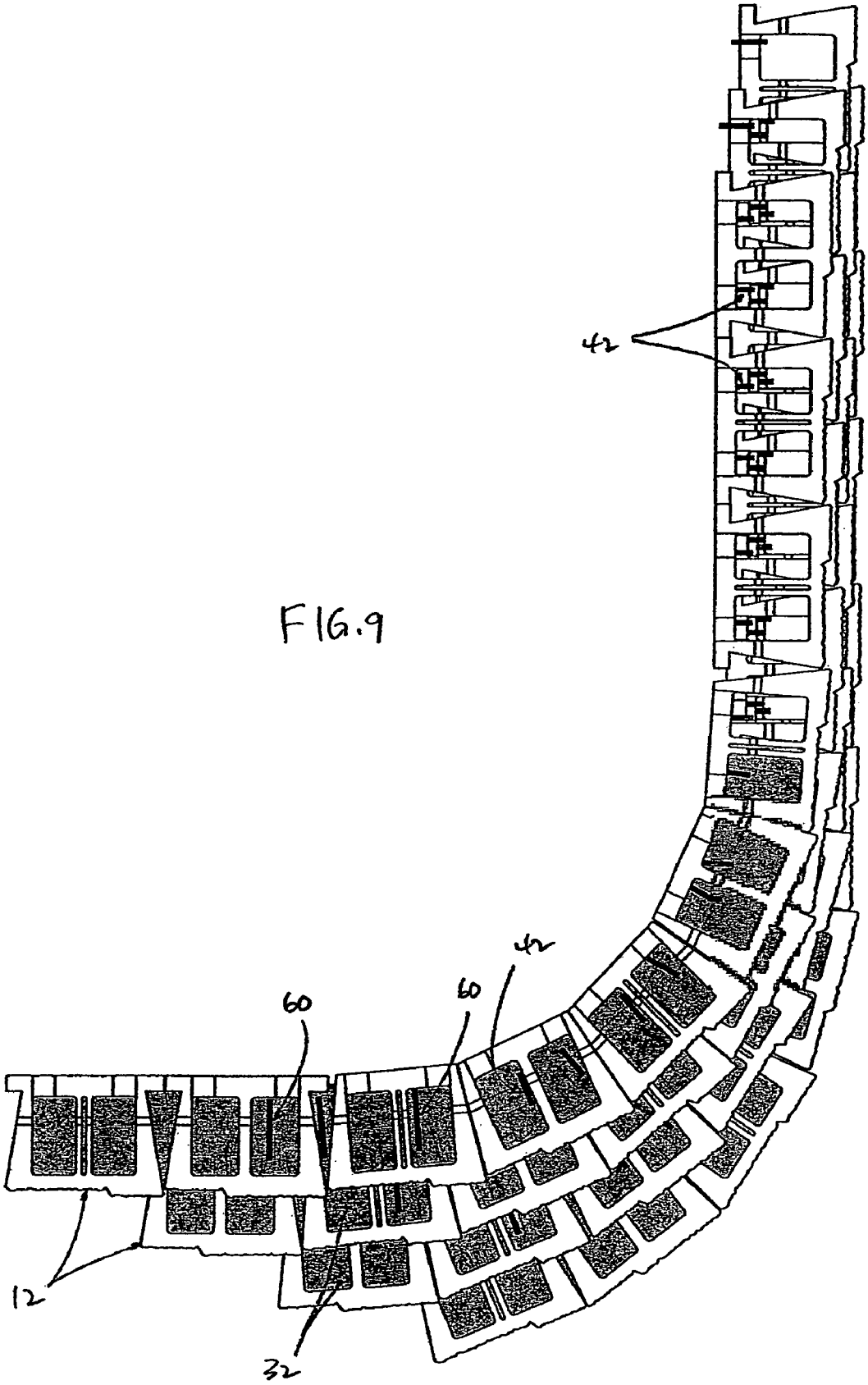
FIGS. 9 and 10 are top plan views of other retaining wall configurations incorporating the planter feature in accordance with the present invention.
Figure 10:
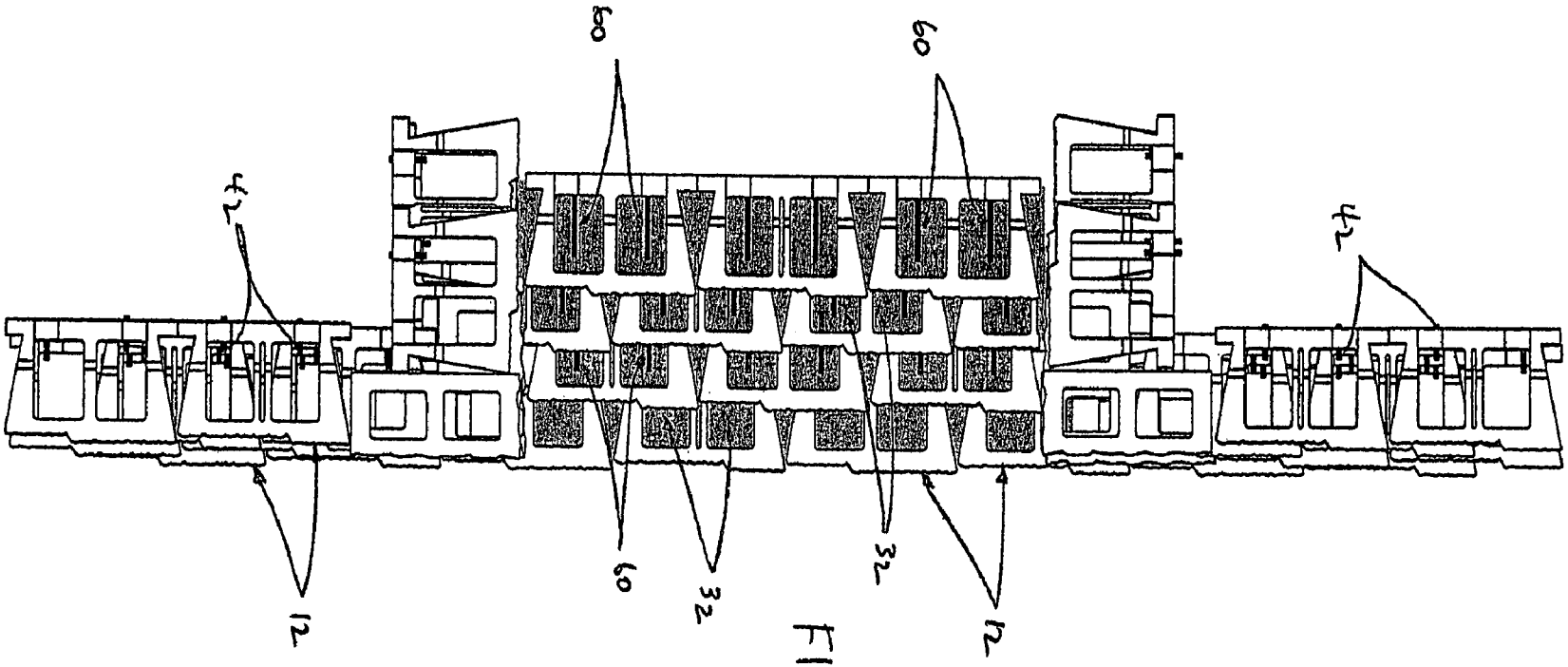

FIG. 7 represents a top plan view of course 14*b* of blocks 12 prior to construction of course 14*c* on top of course 14*b*. As shown, the bottom layer of filter fabric 52 underlies the cores 32 of blocks 12 that will be exposed. Extended clips 60 are mounted to the rear webs 18 of blocks 12 in course 14*b*, where the blocks in cores 14*c* are to be positioned rearwardly so as to expose the cores of blocks 12 in course 14*b*. FIG. 8 illustrates block courses 14*c* and 14*d* constructed on top of course 14*b*, and illustrates the manner in which clips 42 are utilized in combination with extended clips 60 to provide a desired arrangement of courses 14*c* and 14*d* so that only a portion of the cores of blocks 12 in course 14*b* is exposed. FIG. 9 illustrates a construction in which a planter feature can be formed in each course at a radiused end of a retaining wall. FIG. 10 illustrates a construction in which a planter terrace can be formed using blocks 12 by offsetting each course of blocks so that the cores of the blocks in the lower course are exposed. The illustrated wall configurations are examples of the manner in which clips 42 can be used in combination with extended clips 60 to provide a retaining wall with various planter sections. Again, the illustrated wall configurations are representative of any number of different configurations that can be achieved using the clips 42, extended clips 60 and blocks 12 in accordance with the present invention.

It should be understood that the exposed block cores provided by the present invention may be utilized for purposes other than planting of natural plants. For example, and without limitation, the exposed block cores may be used to mount artificial plants in a retaining wall. The exposed block cores may also be used to position any other decorative or functional feature in a retaining wall. As noted previously, the exposed upper surfaces of the blocks may be used to provide a seating or other horizontal support feature in a wall. In this embodiment, one or more cap blocks are secured to the exposed upper surfaces of the lower course blocks, such as by use of an adhesive or any other satisfactory mounting arrangement. In this embodiment, the forward portions of the cap blocks are cantilevered outwardly from the front faces of the lower course blocks. The upper surfaces of the cap blocks may be used for seating or for providing support for other items that may be used in a wall, e.g. planters, birdbaths, water fountains, etc.

Various alternatives and embodiments are contemplated as being within the scope of the following claims particularly pointing out and distinctly claiming the subject matter regarded as the invention.

I claim:

1. A retaining wall, comprising:

a plurality of stacked blocks, wherein each block includes a front face; a rear wall spaced from the front face; an upper block surface; a lower block surface; and a core extending through the block between the upper block surface and the lower block surface, wherein the area of the block disposed between the core and the rear wall of the block defines a rear web and the area between the core and the front face defines a front web;

wherein the wall is formed of a plurality of courses of the blocks, with a joint being formed between the blocks in adjacent upper and lower courses by the lower and upper block surfaces, respectively, of the blocks forming the upper and lower courses, wherein each of the courses comprises a plurality of the blocks placed in a side-by-side relationship;

a plurality of engagement members interposed between the blocks in adjacent courses for preventing relative forward movement between the blocks in adjacent courses, wherein each engagement member is mountable to the rear web of a lower block in a lower course, and wherein the engagement member includes an upstanding projecting portion configured to engage the rear web of an upper block placed in an adjacent upper course for preventing forward movement of blocks in the upper course relative to blocks in the lower course;

wherein the upstanding projecting portion of the clip member is configured to engage the rear web of the upper block so that the front face of the upper block is located rearwardly of the front web of the lower block to expose an upwardly open forward portion of the core of the lower block;

wherein the engagement member comprises a clip member mountable to the rear web of the lower block, wherein the clip member includes a substantially horizontal portion for placement adjacent the surface of the block forming the joint, and wherein the upstanding projecting portion extends upwardly from the horizontal portion; and wherein the clip member is configured to be selectively engaged with the rear web of the lower block in a first orientation in which the upstanding projecting portion is located rearwardly of the rear wall of the lower block, and in a second orientation in which the upstanding projecting portion is located forwardly of the rear wall of the lower block within the core, and wherein the upstanding projecting portion engages the rear web of the upper block when the clip member is in the first orientation, and wherein the clip member includes a second upwardly projecting portion that is configured to engage the rear web of the upper block when the clip member is in the second orientation, wherein the second upwardly projecting portion is configured to position the upper block forwardly so that the core of the lower block is not exposed when the upper block is placed on the lower block.

2. The retaining wall of claim 1, wherein the substantially horizontal portion of the clip member is defined by an inverted U-shaped mounting portion configured to engage the rear web of the lower block, wherein the mounting portion includes a pair of legs that extend downwardly from the substantially horizontal portion of the clip member.

3. The retaining wall of claim 2, further comprising a recess formed in the upper surface of the lower block, wherein the recess is configured to receive the substantially horizontal portion of the clip member to prevent interference with the joint.

4. The retaining wall of claim 1, wherein the rear web includes an inner surface forming the core, and wherein the clip member upwardly projecting portion engages the inner surface of the rear web of the upper block.

5. The retaining wall of claim 4, wherein the inner surface of the rear web of each block has a greater transverse dimension adjacent the lower block surface than adjacent the upper block surface, so that when the clip member is mounted to the lower block, and an upper block is placed on the lower block such that the inner surface of the upper block rear web abuts the clip member upstanding portion, the front face of the upper block is offset rearwardly relative to the front face of the lower block.

6. The retaining wall of claim 1, further comprising planting media positioned in the exposed cores of the lower blocks to enable plants to be planted in the exposed cores of the lower blocks.

7. A method of constructing a retaining wall from a plurality of blocks, comprising the steps of:

providing a plurality of blocks, wherein each block includes a front outer wall presenting a front block face; a rear wall spaced from the front wall; a pair of side walls extending between the front wall and the rear wall; an upper block surface; and a lower block surface; wherein each block has one or more cores therethrough, with the area of the block disposed between the core and the rear wall of the block defining a rear web;

placing a first series of lower blocks in a side-by-side relationship to form a lower course of the blocks;

mounting an engagement member to the rear web of selected ones of the lower blocks, wherein the engagement member includes an upwardly projecting portion that extends upwardly relative to the upper surfaces of the lower blocks, wherein the engagement member is configured such that the upwardly projecting portion of the engagement member is spaced rearwardly from the rear wall of the lower block;

placing a second series of upper blocks on the lower blocks to form an upper course above the lower course, wherein a joint is formed between blocks in the upper and lower courses by the lower and upper surfaces, respectively, of blocks forming the upper and lower courses;

wherein the second series of the blocks are placed on the first series of the blocks such that the rear webs of the upper blocks are engaged by the upwardly projecting portions of the engagement members mounted to the rear webs of the lower blocks, so as to prevent forward movement of the upper blocks relative to the lower blocks, and wherein the engagement members are configured such that, when the upper blocks are placed on the lower blocks, the front block faces of the upper blocks are located rearwardly of the front block faces of the lower blocks and at least a portion of the lower block cores is exposed; and positioning certain of the engagement members in an orientation in which the upwardly projecting portions extend forwardly of the rear webs of the lower blocks so as to be positioned within the cores of the lower blocks, and wherein the engagement members include second upwardly projecting portions that engage the rear webs of upper blocks and are configured such that the front block faces of the upper blocks are positioned so as not to expose the cores of the lower blocks when the lower blocks are placed on the upper blocks.

8. The method of claim 7, further comprising the steps of placing planting media in the exposed lower block cores, and planting plants in the planting media such that the plants extend upwardly above the upper surfaces of the lower blocks.

9. The method of claim 8, further comprising the step of positioning fabric below the lower blocks, wherein the planting media is placed above the fabric.

10. The method of claim 7, further comprising the step of using a second engagement member between lower and upper blocks in adjacent courses of blocks, wherein the second engagement member includes a mounting portion for engagement with the rear web of a lower block and an upstanding projecting portion that extends into the core of an upper block and engages the rear web of the upper block, wherein the upstanding projecting portion of the second engagement member is configured such that the front block faces of the upper blocks are positioned so as not to expose the cores of the lower blocks when the lower blocks are placed on the upper blocks.

11. The method of claim 7, wherein the step of mounting the engagement member to the rear web of a lower block is carried out by engaging an inverted U-shaped mounting portion of the engagement member with the rear web of the lower block.

12. The method of claim 7, further comprising the step of securing a cap block having an upwardly facing support surface over the exposed cores of the lower blocks.

* * * * *